US010214902B1

(12) United States Patent
Wheeler et al.

(10) Patent No.: US 10,214,902 B1
(45) Date of Patent: Feb. 26, 2019

(54) STUD LAYOUT LOCKER

(71) Applicant: FlexAbility Concepts, LLC, Oklahoma City, OK (US)

(72) Inventors: Frank Wheeler, Oklahoma City, OK (US); Robert Widmer, Oklahoma City, OK (US)

(73) Assignee: FlexAbility Concepts, LLC, Oklahoma City, OK (US)

( * ) Notice: Subject to any disclaimer, the term of this patent is extended or adjusted under 35 U.S.C. 154(b) by 0 days.

(21) Appl. No.: 15/249,094

(22) Filed: Aug. 26, 2016

Related U.S. Application Data

(60) Provisional application No. 62/210,118, filed on Aug. 26, 2015.

(51) Int. Cl.
*E04H 12/18* (2006.01)
*E04B 2/60* (2006.01)
*E04C 3/32* (2006.01)

(52) U.S. Cl.
CPC . *E04B 2/60* (2013.01); *E04C 3/32* (2013.01)

(58) Field of Classification Search
CPC ..... E04C 3/32; E04B 2/60
USPC ..... 52/655.1, 317, 653.1, 646
See application file for complete search history.

(56) References Cited

U.S. PATENT DOCUMENTS 3,501,185 A * 3/1970 Downing, Jr. ..... E04B 9/122 403/252
3,778,952 A * 12/1973 Soucy ..... E04B 2/763 403/253
4,235,054 A * 11/1980 Cable ..... E04B 2/58 52/210
6,164,028 A * 12/2000 Hughes ..... E04B 2/764 52/243
6,393,794 B1 * 5/2002 Pellock ..... E04B 7/024 52/203
6,993,882 B2 * 2/2006 Crawford ..... E04B 7/022 52/696
7,017,310 B2 * 3/2006 Brunt ..... E04B 2/763 174/66
7,520,100 B1 * 4/2009 Herrman ..... E04B 2/7457 52/238.1
7,596,921 B1 * 10/2009 diGirolamo ..... E04C 3/07 248/168
7,836,657 B1 * 11/2010 diGirolamo ..... E04B 2/765 52/317
8,011,160 B2 * 9/2011 Rice ..... E04B 2/7457 248/247
8,205,402 B1 * 6/2012 diGirolamo ..... E04B 2/765 52/241
D702,533 S * 4/2014 Noturno ..... E04G 21/1891 D8/354
8,683,772 B2 * 4/2014 Friis ..... E04B 7/022 52/691

(Continued)

*Primary Examiner* — Basil S Katcheves
(74) *Attorney, Agent, or Firm* — Hall Estill Attorneys at Law

(57) ABSTRACT

A stud layout locker and associated method having a longitudinal beam. A tab end at one end of the longitudinal beam defines an upstanding tab and a pair of opposing slots sized to receivingly engage a stud web. A slot end at the opposing end of the longitudinal beam has a flange defining a portion of a slot. The tab and slot are sized so that the tab of a first stud layout locker is insertable into the slot of a second stud layout locker and so that the tab is substantially parallel and adjacent the flange.

11 Claims, 17 Drawing Sheets

(56) References Cited

U.S. PATENT DOCUMENTS

| | | | | |
|---|---|---|---|---|
| 9,109,361 | B2 * | 8/2015 | Daudet | E04C 3/07 |
| 2002/0059773 | A1 * | 5/2002 | Elderson | E04B 2/58<br>52/667 |
| 2003/0106280 | A1 * | 6/2003 | diGirolamo | E04B 2/7457<br>52/656.1 |

* cited by examiner

STUD LAYOUT LOCKER

RELATED APPLICATIONS

This application claims the benefit of the earlier-filed U.S. patent application No. 62/210,118 filed on Aug. 26, 2015.

SUMMARY

Some embodiments of this technology contemplates a stud layout locker having a longitudinal beam. A tab end at one end of the longitudinal beam defines an upstanding tab and a pair of opposing slots sized to receivingly engage a stud web. A slot end at the opposing end of the longitudinal beam has a flange defining a portion of a slot. The tab and slot are sized so that the tab of a first stud layout locker is insertable into the slot of a second stud layout locker and so that the tab is substantially parallel and adjacent the flange.

BRIEF DESCRIPTION OF THE DRAWINGS

Details of various embodiments of the present technology are described in connection with the accompanying drawings that bear similar reference numerals.

DESCRIPTION

Initially, this disclosure is by way of example only, not by limitation. The illustrative constructions and associated methods disclosed herein are not limited to use or application for bracing any specific system or in any specific environment. That is, the disclosed technology is not limited to usage for reinforcing upright framing members of a track-and-stud wall as is disclosed in the illustrative embodiments. Thus, although the instrumentalities described herein are for the convenience of explanation, shown and described with respect to exemplary embodiments, the skilled artisan understands that the principles herein may be applied equally in other types of systems and environments involving the bracing of structural systems.

Walls framed with metal components instead of traditional wood components are becoming more prevalent. A metal-framed wall structure generally consists of a number of upright studs attached at opposing ends to upper and lower tracks. The lower track is supported upon a foundation such a floor, and the upper track is supported by an overhead structure. Sections of the stud-and-track assemblies are joined end-to-end to form wall structures of desired length and height. Utility accessories such as wiring and cabling are routed through openings in the studs and terminated in junction boxes that are supported by the studs. Finishing materials are attached to cover the studs and tracks and provide an aesthetically pleasing exposure for the living or working space.

Typically the metal studs are braced for a couple of reasons. First, live loads and wind loads can cause deflection of the studs. To prevent plastic deformation, such as buckling, lateral braces are used to strengthen the frame structure. Second, the lateral braces can advantageously be used to position the studs at the proper layout spacing. The lateral braces also urge adjacent studs to be parallel, removing twisting and bending variations in the studs to provide a planar attachment framework for the finishing materials.

Previously attempted solutions for providing a lateral support can be cumbersome to install. Some previous attempts use long support bars that have to be threaded through openings in multiple studs. That becomes problematic dealing with squaring up and bracing a number of studs at the same time. Other previous attempts involve supports that require a number of fasteners for attachment to the studs. That is painstakingly tedious because it requires constantly switching between using and storing a tool for driving the fasteners. There is opportunity for improvement in a solution that is simple to install while providing superior stabilization. It is to those improvements that the embodiments of this technology are directed.

Figure 1:
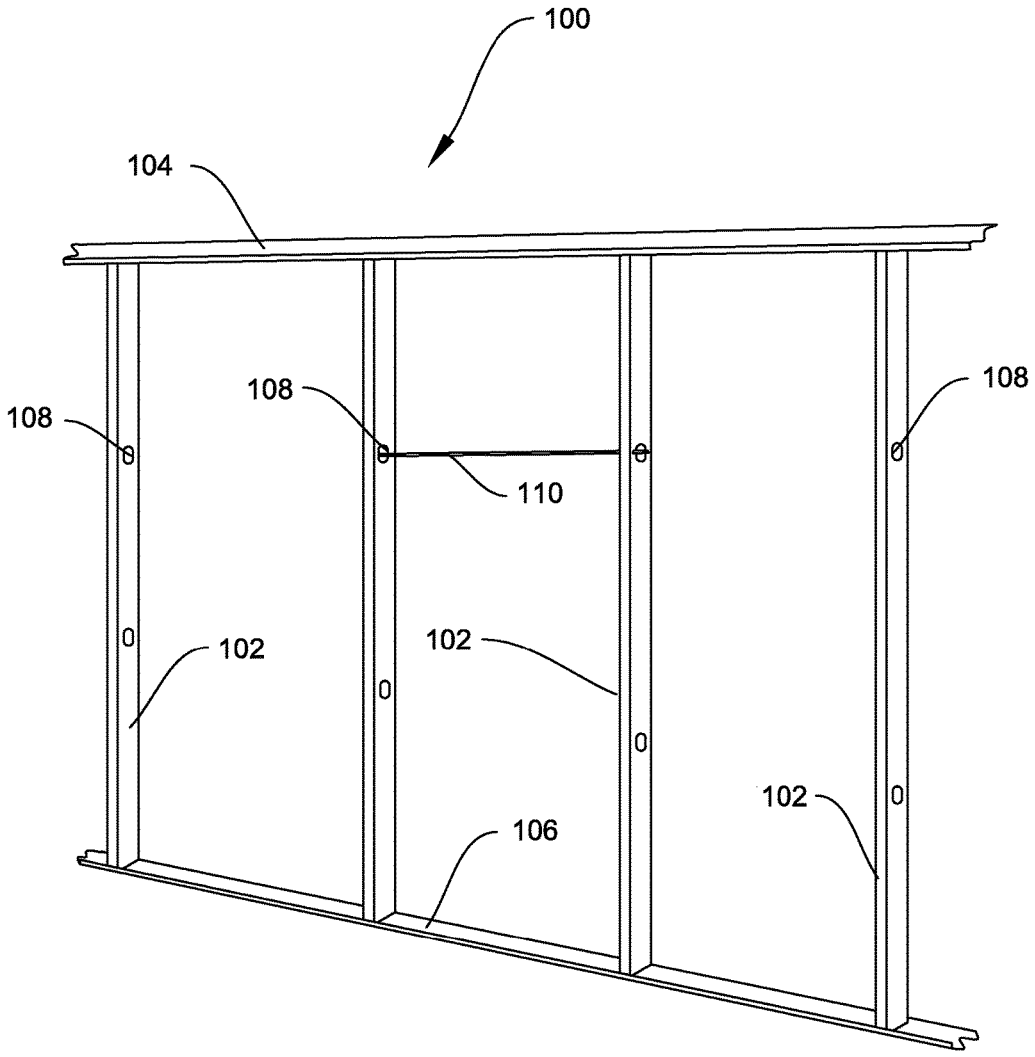
FIG. 1 depicts a metal-framed wall structure.

FIG. 1 depicts a metal-framed wall structure 100 consisting of a plurality of upright studs 102 each fastened at opposing ends to top and bottom rails 104, 106, respectively. Each stud 102 has a pattern of openings 108 into which a stud layout locker ("SLL") 110 is inserted in accordance with embodiments of this technology. The openings 108 are otherwise also used for routing utilities components through the wall such as wiring and cabling and the like.

Figure 2:
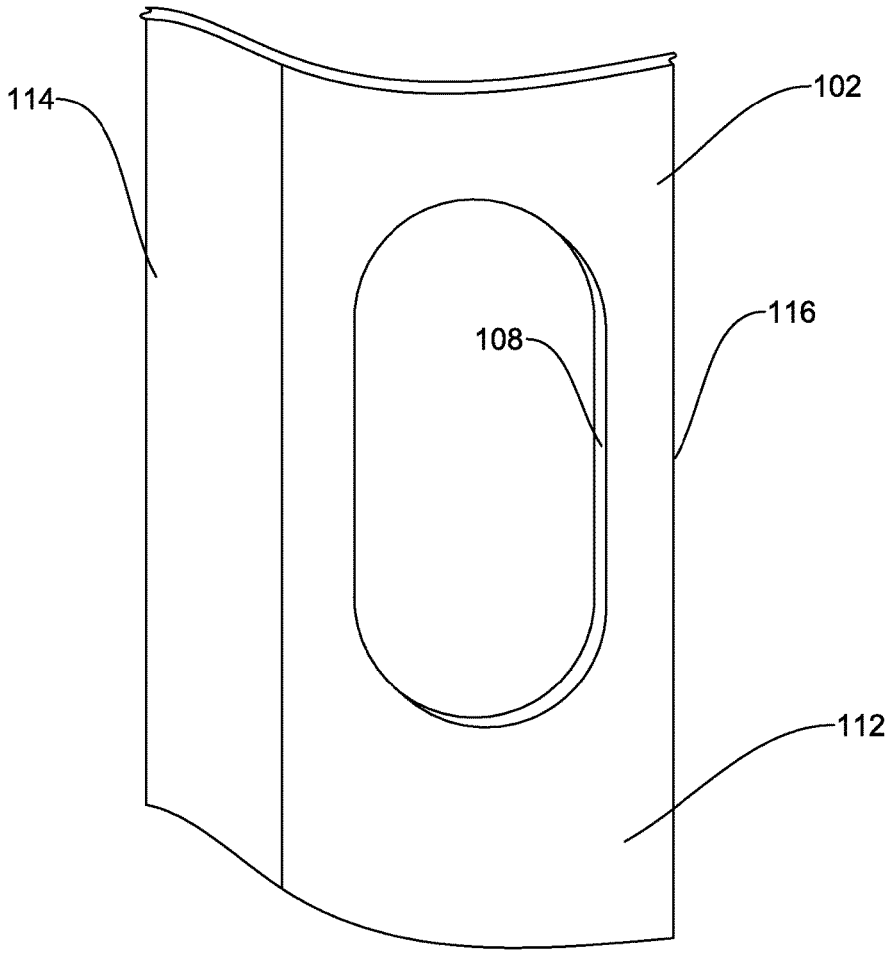
FIG. 2 is an enlarged portion of FIG. 1 depicting an opening in each stud.
Figure 3:
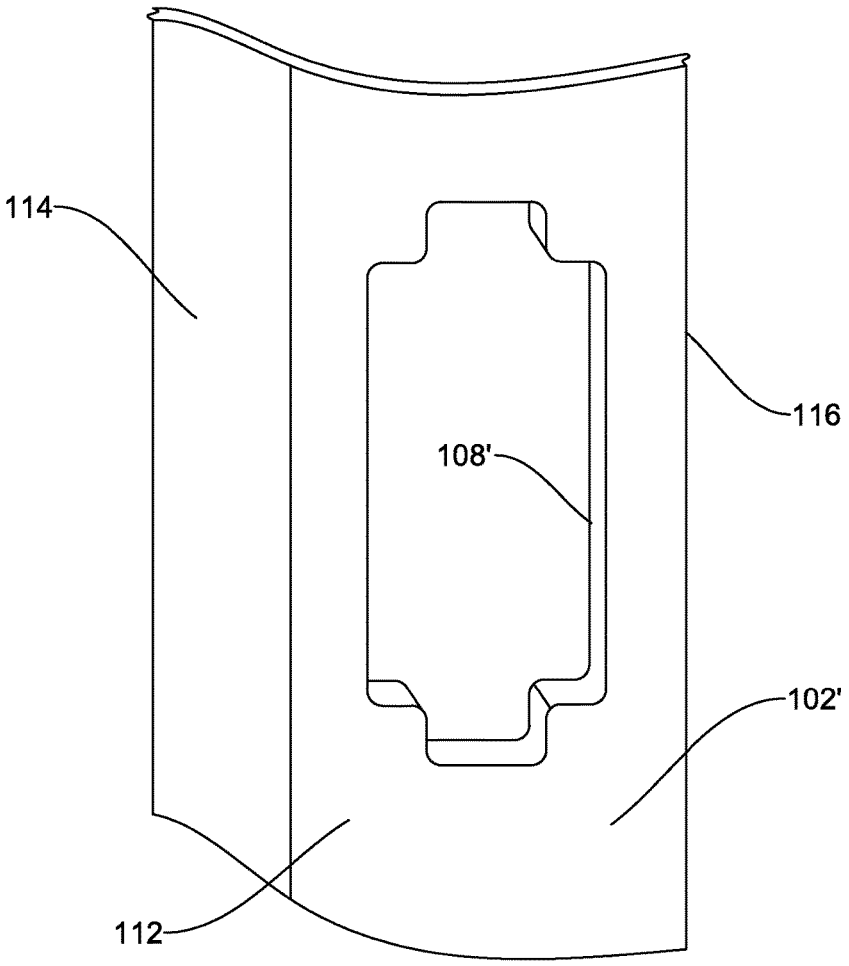
FIG. 3 is similar to FIG. 2 but depicting an alternative opening.

FIG. 2 is an enlarged depiction of a portion of one of the studs 102. The studs 102 depicted here are C-shaped members having a web 112 from which opposing flanges 114, 116 extend. Although the openings 108 in these illustrative embodiments are oval-shaped, the contemplated embodiments are not so limited. FIG. 3 illustrates a stud 102' having an alternative shaped opening 108', and the shape of the opening 108 is in no way limiting of the contemplated embodiments of this technology. That is, the skilled artisan having read this description understands that the SLL 110 can be configured to matingly engage with an opening 108 of any particular shape.

Figure 4:
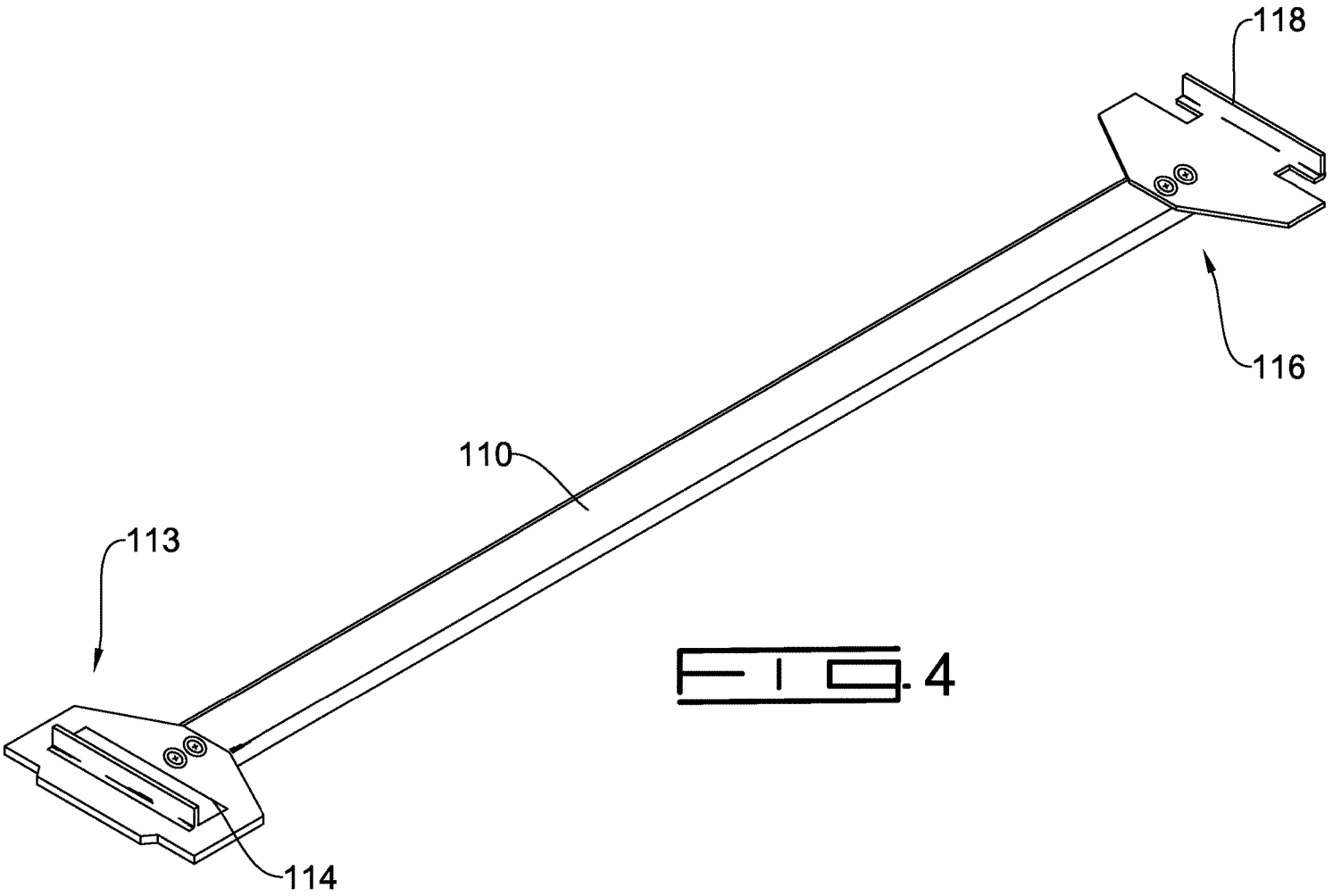
FIG. 4 depicts a stud layout locker ("SLL") that is constructed in accordance with embodiments of this technology.

FIG. 4 is an isometric depiction of the SLL 110. Each SLL 110 has a slot end 113 forming a predominant slot 114, and a tab end 116 forming a predominant protuberant tab 118. The tab 118 and slot 114 are sized so that the tab 118 of one SLL 110 is insertable into the slot 114 of another SLL 110 for locking them together with a stud 102 sandwiched therebetween, as described in detail herein.

Figure 5:
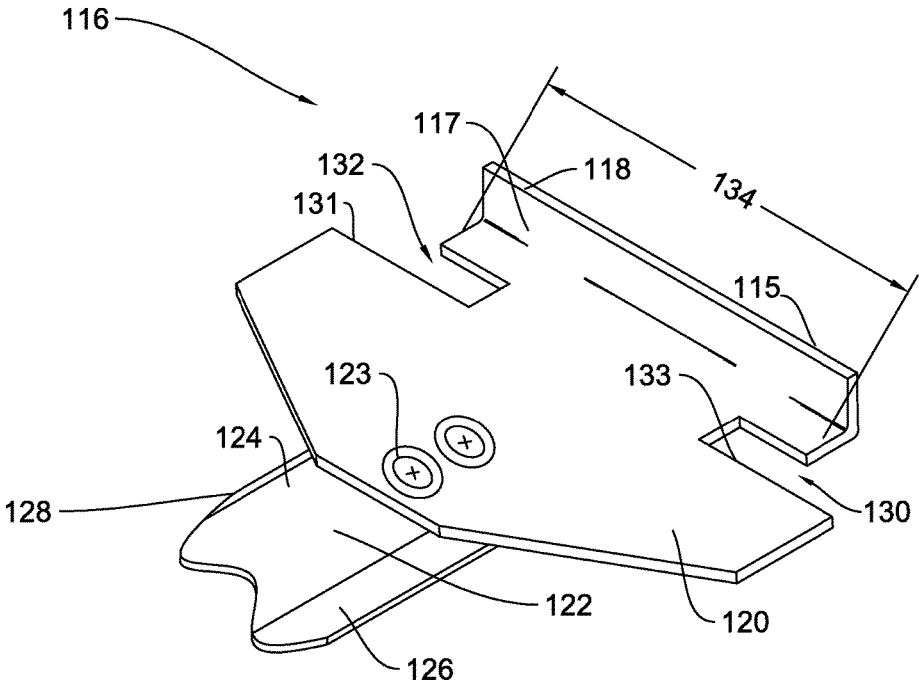
FIG. 5 is an enlarged portion of FIG. 4 depicting the tab end of the SLL in FIG. 4.
Figure 6:
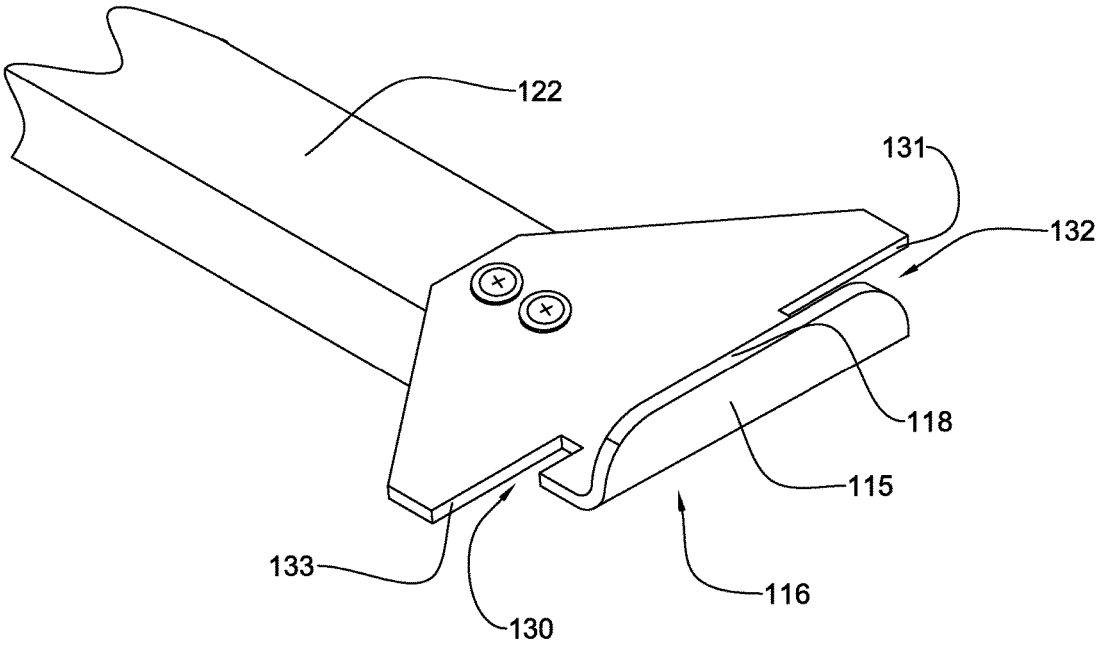
FIG. 6 is similar to FIG. 5 but depicting a different perspective.
Figure 7:
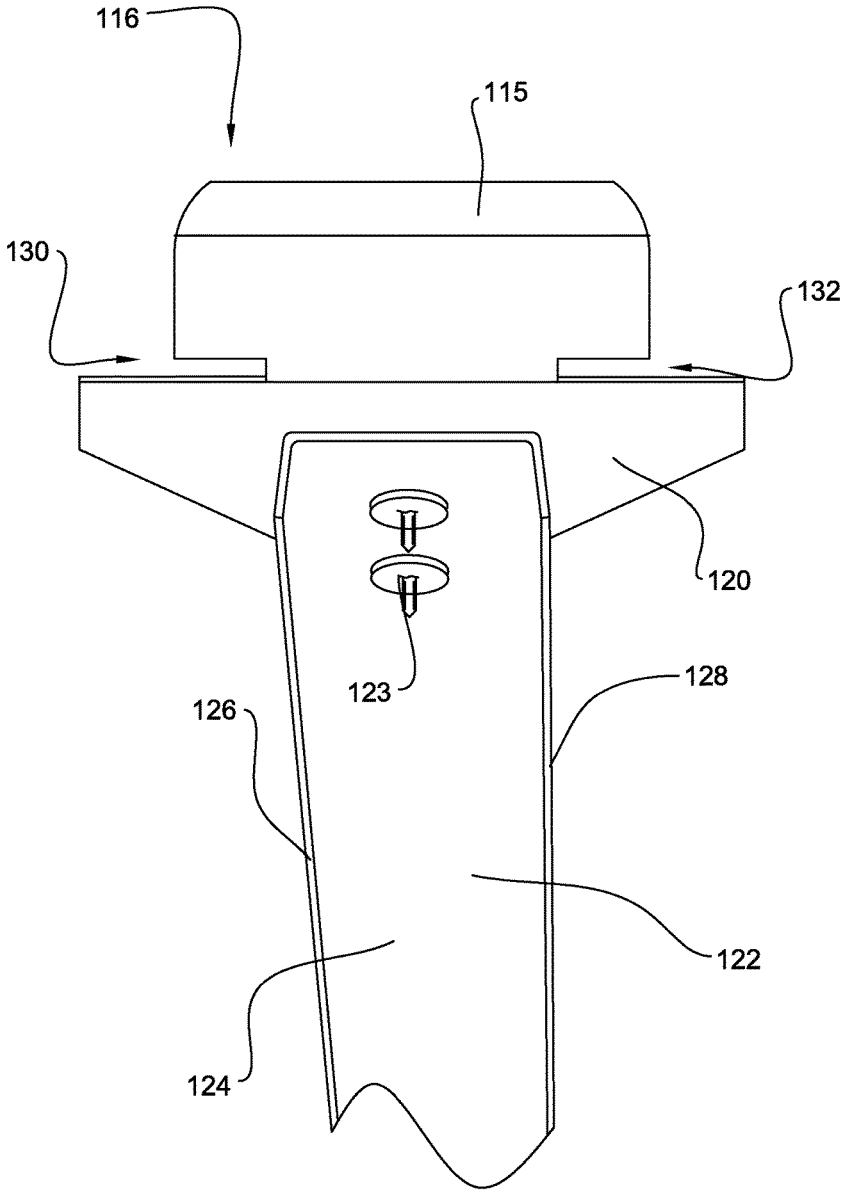
FIG. 7 is similar to FIG. 5 but depicting a bottom view.

FIG. 5 is an enlarged depiction of the tab end 116 of the SLL 110. In these illustrative embodiments the tab 118 is a portion of a tab end member 120 that is attached to a U-shaped beam 122 by fasteners 123. The tab 118 has an upstanding leading surface 115 opposing an upstanding trailing surface 117. The beam 122 is sized to span a predetermined distance between adjacent studs 102, having a longitudinal web 124 and opposing flanges 126, 128 extending from the web 124. The tab end member 120 defines opposing slots 130, 132 that are sized to receivingly engage the stud web 112 (see FIG. 3). A leading end of the tab end member 120 defining one side of the slots 130, 132 has a width 134 suited for inserting into the opening 108. Preferably a trailing end of the tab end member 120 defining the other side of the slots 130, 132 is wider so that it contactingly engages a comparatively larger portion of the stud web 112 when installed. Particularly, the trailing end of the tab end member 120 has edges 131, 133 that abuttingly engage the stud web 112 when installed. FIG. 6 depicts a different perspective of the tab end member 116 showing the leading surface 115 of the tab 118. FIG. 7 depicts a bottom view of the tab end member 116. Although in the illustrative embodiments the fasteners 123 are self-drilling screws, the contemplated embodiments are not so limited. Alternatively, attachment of the tab end member 120 can be otherwise such as by other types of fasteners or weldments. In other alternative embodiments the tab end member 120 and the beam 122 can be unitarily formed.

Figure 8:
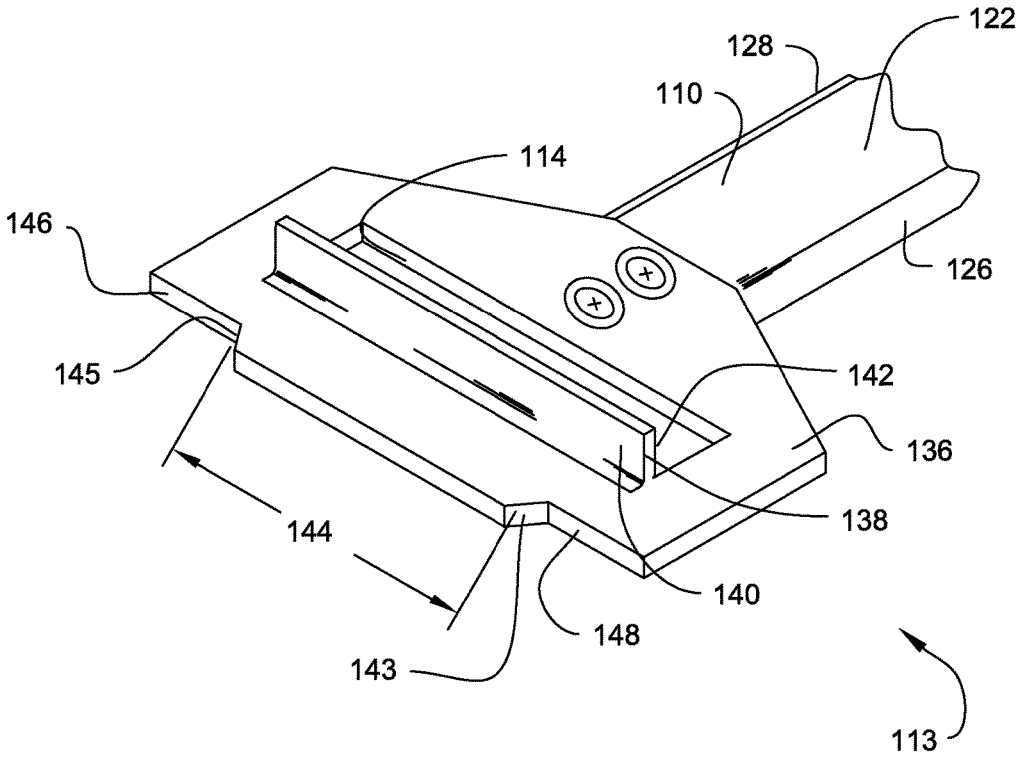
FIG. 8 is an enlarged portion of FIG. 4 depicting the slot end of the SLL in FIG. 4.

FIG. 8 is an enlarged depiction of the slot end 113 of the SLL 110. In these illustrative embodiments the slot 114 is defined by a slot end member 136 attached to the beam 122 by fasteners 123. An upstanding flange 138 defines a portion of the slot 114. The flange 138 has an upstanding leading surface 140 and an opposing trailing surface 142. As described in detail below, the flange 138 acts a lever for transferring a force (such as the hammer blow described below) to operably interlock the SLL 110 to the stud web 112. A leading end of the slot end member 136 has a width 144 sized for inserting into the stud opening 108. A trailing end of the slot end member 136 is wider so the edges 146, 148 abuttingly engage the stud web 112 when installed. As described below, the width 144 is defined by tapered edges 143, 145 transitioning to the edges 146, 148 to further interlock the SLL to the stud web 112 in response to the force.

Figure 9:
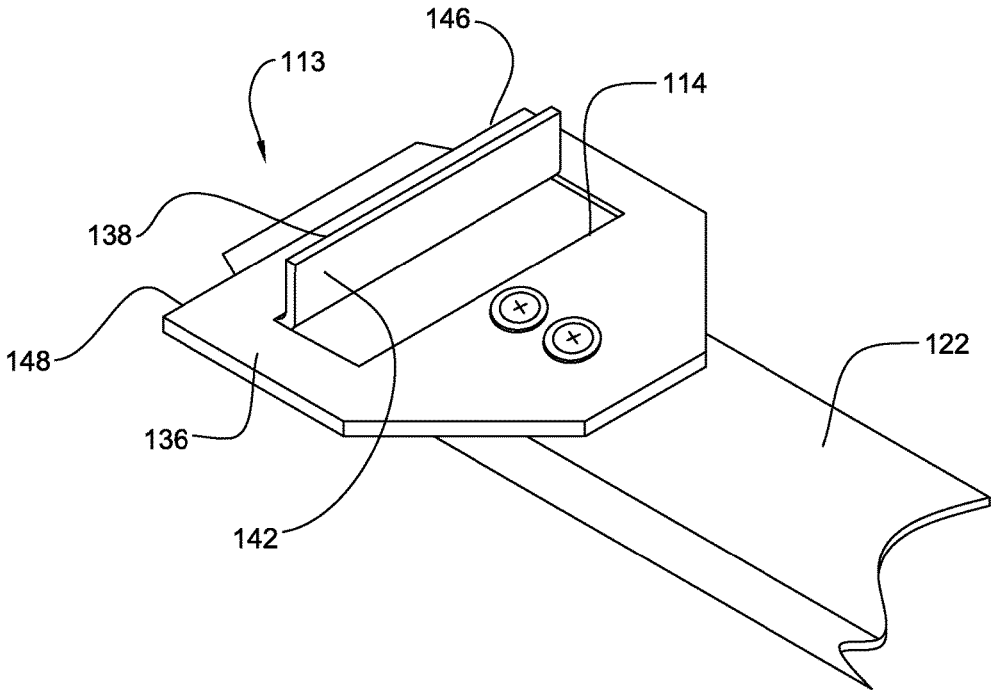
FIG. 9 is similar to FIG. 8 but depicting a different perspective.
Figure 10:
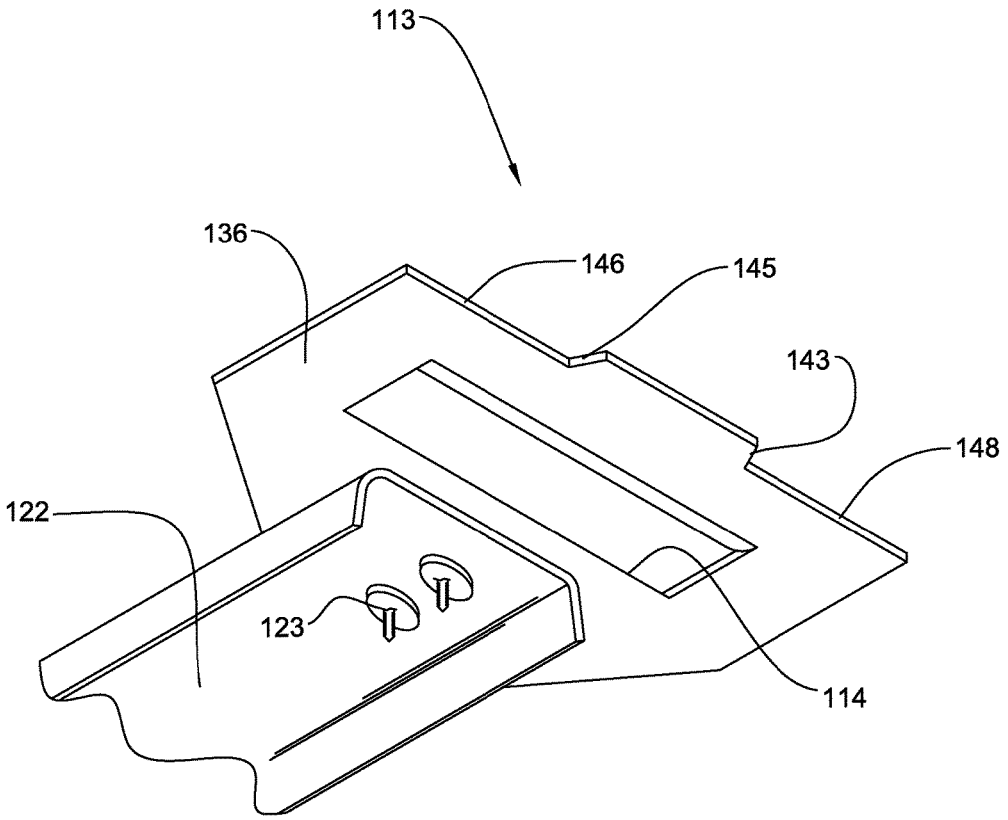
FIG. 10 is similar to FIG. 8 but depicting a bottom view.

FIG. 9 depicts a different perspective of the slot end member 136 showing the trailing surface 142 of the flange 138. FIG. 10 depicts a bottom view of the slot end member 136. As described above, although in the illustrative embodiments the fasteners 123 are self-drilling screws, the contemplated embodiments are not so limited. Alternatively, attachment of the slot end member 136 can be otherwise such as by other types of fasteners or weldments. In other alternative embodiments the slot end member 136 and the beam 122 can be unitarily formed.

Figure 11:
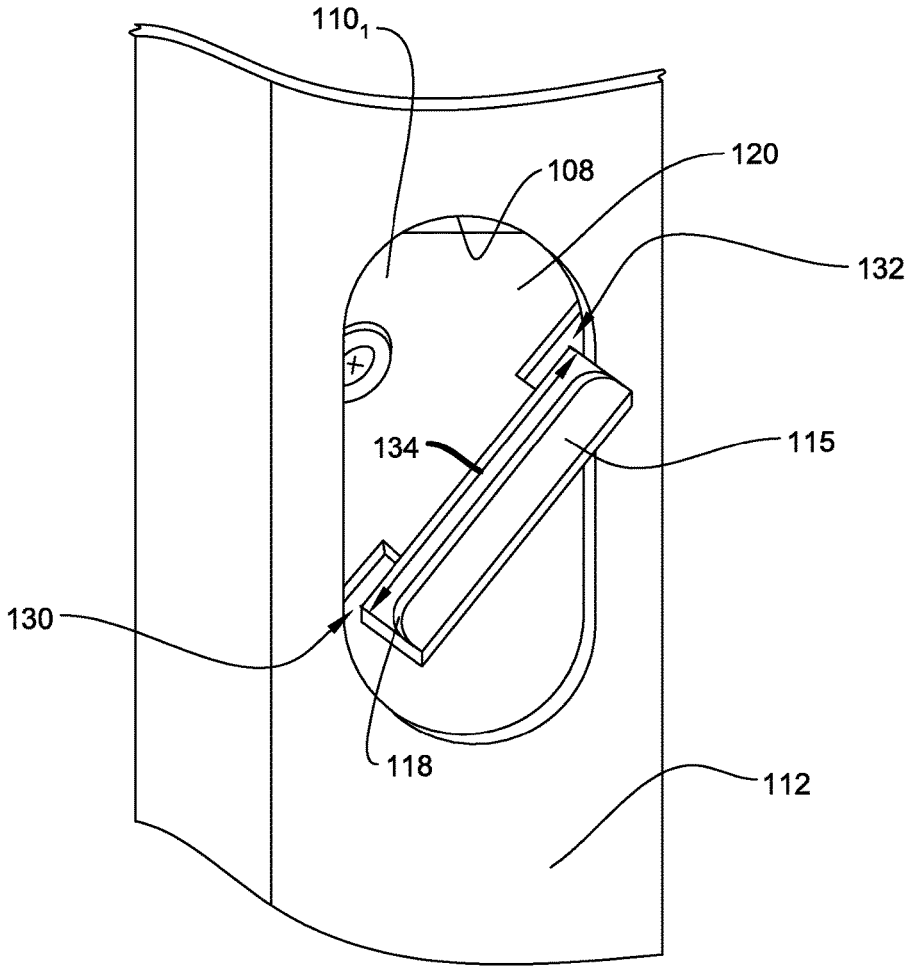
FIG. 11 depicts inserting the tab end of the SLL into the opening in the stud.

FIG. 11 depicts inserting the tab end 116 of one SLL $\mathbf{110}_1$ into the stud opening 108. The width 134 is wider than the width of the opening 108, requiring the SLL $\mathbf{110}_1$ to be angled as depicted in order to insert the tab end 116 into the opening 108. The opposing slots 132, 134 are aligned with the stud web 112 so that the SLL 1101 can be rotated into its operable position as depicted in FIG. 12.

Figure 12:
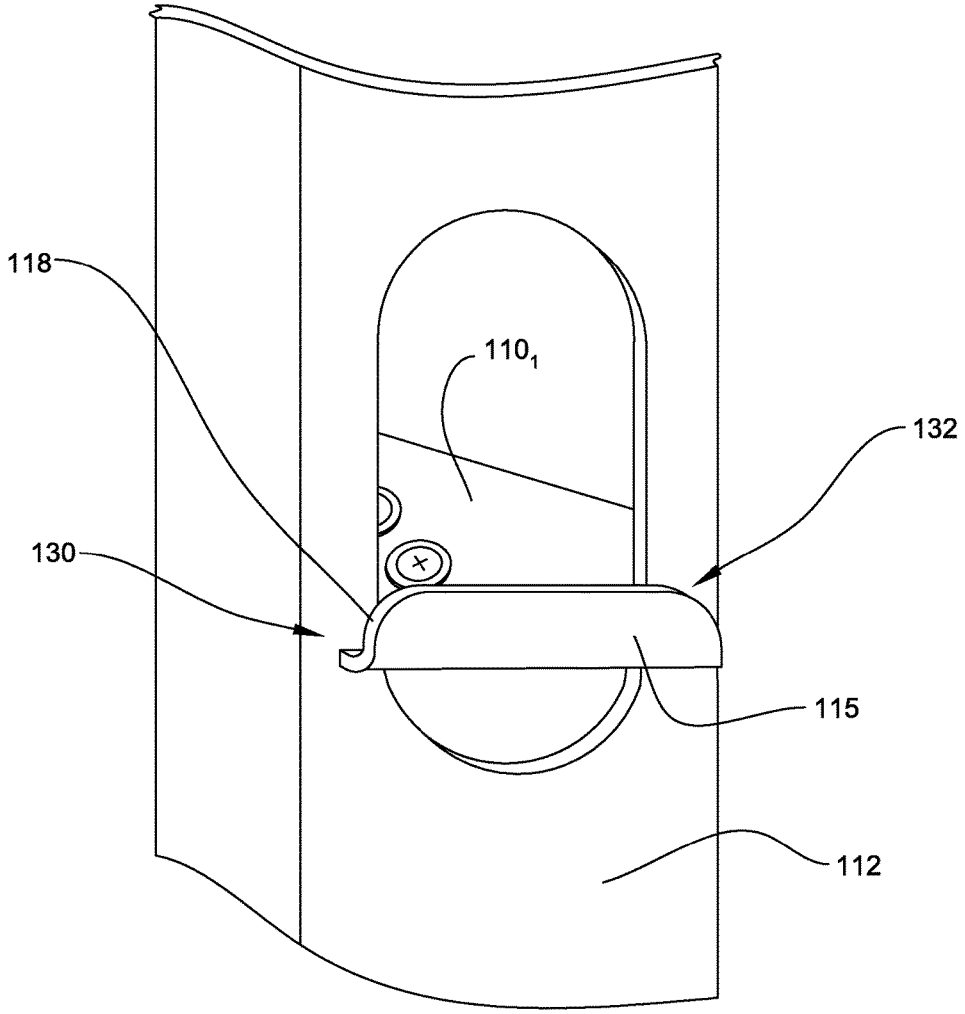
FIG. 12 depicts the tab end of the SLL fully inserted into the opening in the stud.
Figure 13:
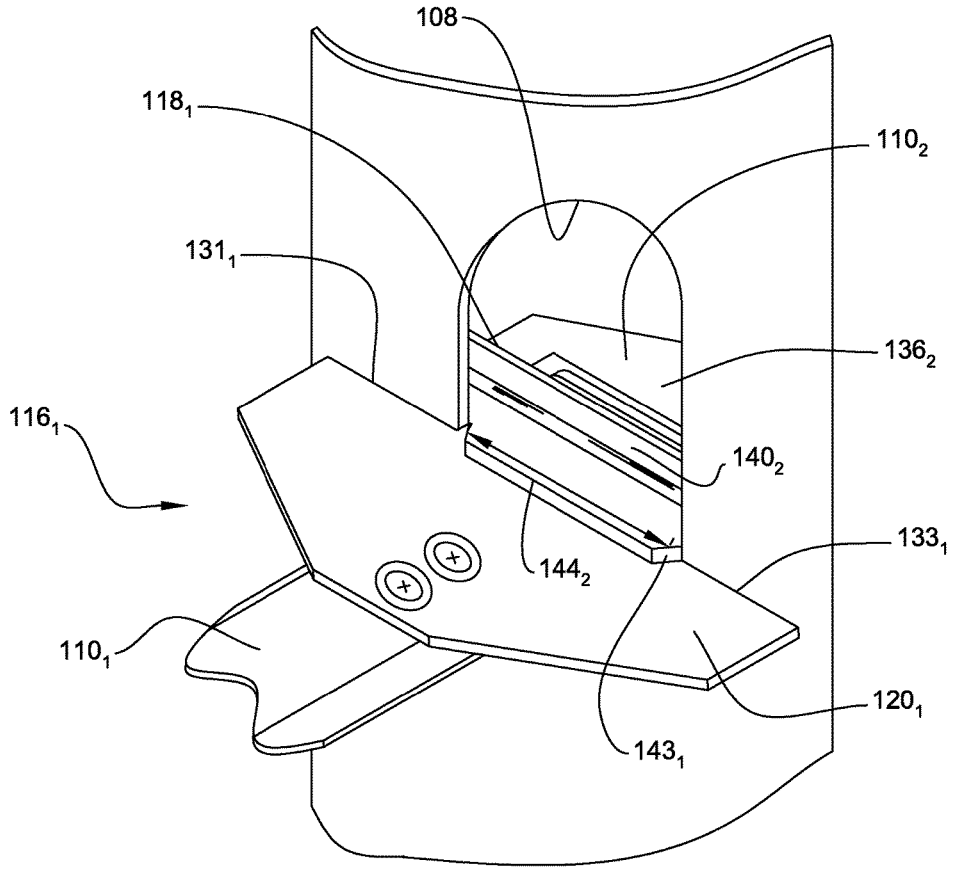
FIG. 13 depicts the slotted end of another SLL fully inserted into the opening in the stud and on the tab end of the SLL in FIG. 12.
Figure 14:
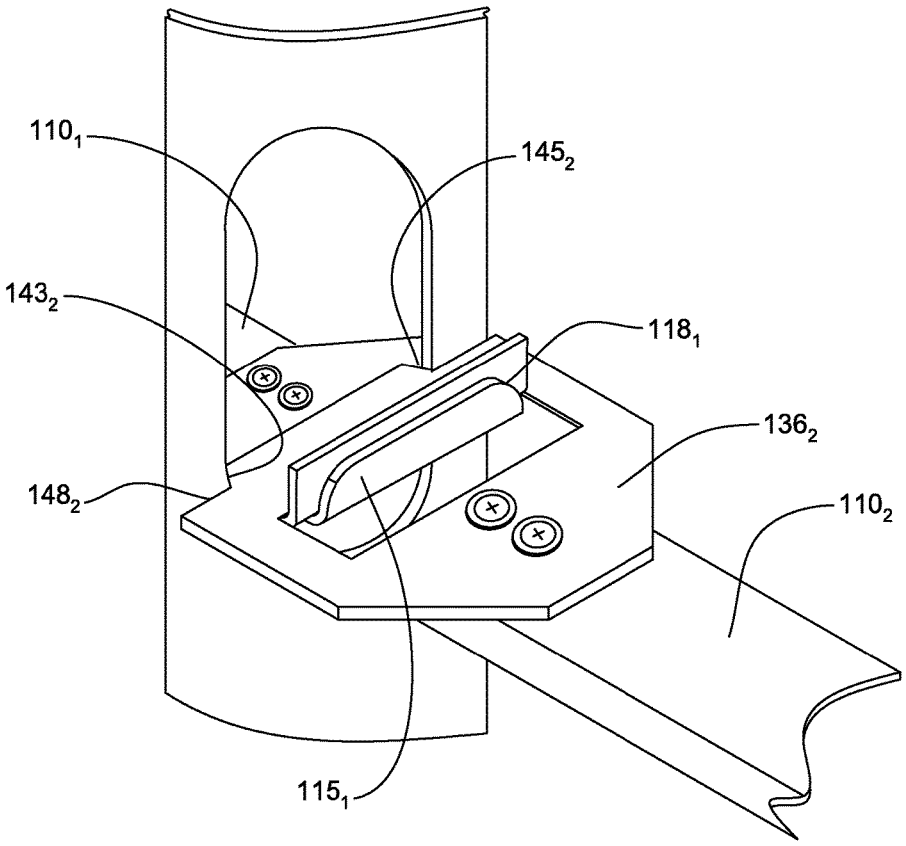
FIG. 14 is similar to FIG. 13 but depicting a different perspective.

FIG. 13 depicts a perspective of the other side of the stud 102 as compared to FIG. 12. The edges $\mathbf{131}_1$, $\mathbf{133}_1$ of the SLL $\mathbf{110}_1$ are adjacent the stud web 112. FIG. 13 also depicts another SLL $\mathbf{110}_2$ has been positioned so that its slot end $\mathbf{113}_2$ mates with the tab end $\mathbf{116}_1$ of the other SLL $\mathbf{110}_1$. By "mated" it is meant that the slot $\mathbf{114}_2$ of the SLL $\mathbf{110}_2$ has been aligned with and has received the tab $\mathbf{118}_1$ of the other SLL $\mathbf{110}_1$. Note that preferably the width $\mathbf{144}_2$ of the slot end member $\mathbf{136}_2$ is slightly narrower than the width of the stud opening 108 so that the SLL $\mathbf{110}_2$ can be aligned without rotating it, making engagement of the tab $\mathbf{118}_1$ into the slot $\mathbf{114}_2$ easier. FIG. 14 depicts the perspective of FIG. 12 with the SLL $\mathbf{110}_2$ mated. The edges $\mathbf{146}_2$, $\mathbf{148}_2$ of the slot end member $\mathbf{136}_2$ are adjacent the stud web 112, opposing the edges $\mathbf{131}_1$, $\mathbf{133}_1$ on the other side of the stud web 112 as depicted in FIG. 13. Note that in the mated position depicted that the tapered edges $\mathbf{143}_2$, $\mathbf{145}_2$ of the slot end member $\mathbf{136}_2$ are adjacent, preferably contacting, the edges of the stud opening 108.

Figure 15:
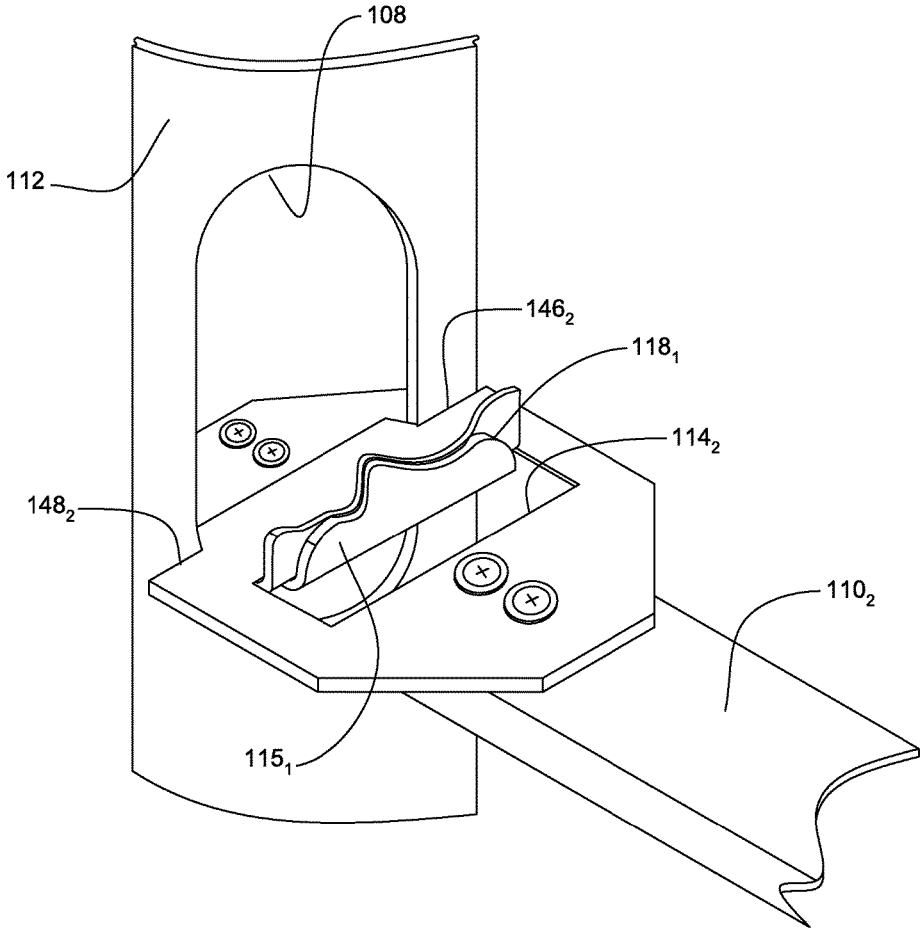
FIG. 15 is similar to FIG. 13 but depicting the tab is upset.
Figure 16:
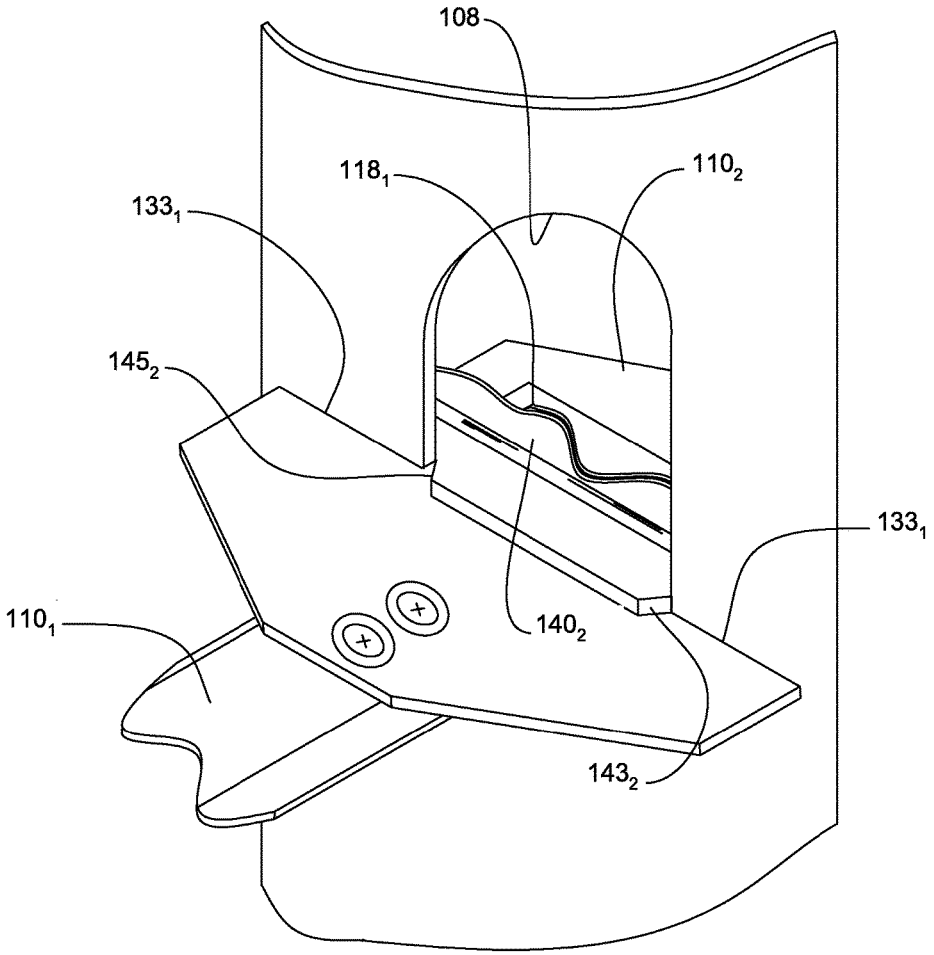
FIG. 16 is similar to FIG. 15 but depicting a different perspective.

FIG. 15 depicts the same perspective as FIG. 14 but after the SLLs $\mathbf{110}_1$, $\mathbf{110}_2$ have been interlocked together by upsetting the tab $\mathbf{118}_1$. The upset can be caused by a blow, such as a hammer blow, to the leading surface $\mathbf{115}_1$ of the tab $\mathbf{118}_1$. The blow toward the opening 108 causes the edges $\mathbf{146}_2$, $\mathbf{148}_2$ to be driven into abutting engagement against the stud web 112 as shown in more detail in FIG. 17 below. FIG. 16 depicts the perspective of FIG. 13 after upsetting the flange $\mathbf{118}_1$ against the flange $\mathbf{138}_2$ of the SLL $\mathbf{110}_2$.

Figure 17:
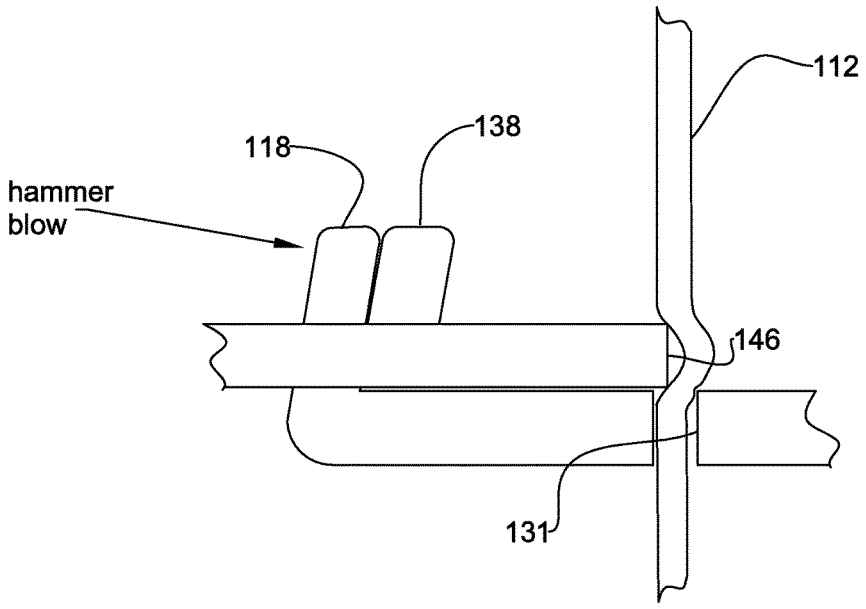
FIG. 17 is an enlarged cross-sectional depiction of the upset condition depicted in FIGS. 15 and 16.

FIG. 17 is an enlarged cross-sectional depiction after the SLLs $\mathbf{110}_1$, $\mathbf{110}_2$ are interlocked together. The blow as described above causes the edges $\mathbf{146}_2$, $\mathbf{148}_2$ (only 146 depicted) of the SLL $\mathbf{110}_2$ (FIG. 15) to plastically upset the stud web 112 into abutting engagement against the edges $\mathbf{131}_1$, $\mathbf{133}_1$ (only 131 depicted) of the SLL $\mathbf{110}_1$, thereby interlocking, crimping, the SLLs $\mathbf{110}_1$, $\mathbf{110}_2$ and the stud web 112 together. Movement of the edges $\mathbf{146}_2$, $\mathbf{148}_2$ toward the stud web 112 also shears the tapered edges $\mathbf{143}_2$, $\mathbf{145}_2$ of the SLL $\mathbf{110}_2$ into the edges of the stud opening 108, further interlocking the SLL $\mathbf{110}_2$ to the stud web 112. Thus, the SLLs $\mathbf{110}_1$, $\mathbf{110}_2$ are interlocked together by upsetting the tab $\mathbf{118}_1$ and the SLLs $\mathbf{110}_1$, $\mathbf{110}_2$ are interlocked to the stud 102 by being sandwiched between the edges $\mathbf{131}_1$, $\mathbf{133}_1$, and the edges $\mathbf{146}_2$, $\mathbf{148}_2$ and by the shearing of the tapered edges $\mathbf{143}_2$, $\mathbf{145}_2$ of the SLL $\mathbf{110}_2$ into the stud web 112.

This process of inserting adjacent SLLs 110 into a stud opening 108 and interlocking the SLLs 110 together with the stud web 112 interlocked therebetween is repeated for each stud. The SLLs 110 are sized to have a length such that when the adjacent SLLs 110 are engaged with each other, before the blow to interlock them, the studs are spaced according to the desired layout spacing. The wider edges 131, 133 of the tab end 116 and wider edges 146, 148 of the slot end 113 serve to square up the stud 102 for easier and better fit for attachment to the top and bottom rails 104, 106 (FIG. 1).

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

What is claimed:

1. A stud layout locker in a bracing assembly configured to support studs in a wall structure, each stud having a web defining an opening, the bracing assembly having a number of the stud layout lockers operably joined together end-to-end and substantially horizontal with a stud captured between adjacent stud layout lockers, each stud layout locker comprising:

a longitudinally-extending beam;

a first end of the horizontal beam defining an upwardly-directed tab having a laterally-directed width, and having edges defining opposing transversely-directed open-ended slots configured to receive the web between opposite edges of the slots in the operably joined together end-to-end configuration; and a second end of the horizontal beam having an upwardly-directed flange defining a slot having a laterally-directed width that is larger than the laterally-directed width of the upwardly-directed tab.

2. The stud layout locker of claim 1 configured to span between adjacent studs.

3. The stud layout locker of claim 2 wherein the flange of the second end of each stud layout locker is operably parallel to and adjacent the tab of the first end of each stud layout locker.

4. The stud layout locker of claim 2 wherein the second end of each stud layout locker has a protuberant portion that operably extends into the opening in the stud web.

5. The stud layout locker of claim 4 where the protuberant portion has tapered sides.

6. The stud layout locker of claim 2 wherein the second end of each stud layout locker has an edge that operably abuts against the stud web.

7. The stud layout locker of claim 2 wherein each tab in the first end is longer than each flange in the second end.

8. The stud layout locker of claim 2 wherein the tab in the first end is configured to be upset into the flange of the second end to join adjacent stud layout lockers together.

9. A method of using a stud layout locker for bracing studs in a wall structure, comprising:

obtaining a plurality of the stud layout lockers each having a longitudinally-directed beam, a first end of the longitudinally-directed beam defining an upwardly-directed tab and a second end of the longitudinally-directed beam defining an enclosed slot;

inserting the first end of a first stud layout locker into an opening in a web portion of the stud;

while the first end is inserted in the opening, aligning opposing transversely-directed open-ended slots in the first end with the web portion;

while the slots are aligned with the web portion, supporting the first end in the opening by moving the first end to position the web between opposite edges of each transversely-directed open-ended slot;

placing the second end of a second stud layout locker over the first end of the first stud layout locker so that the tab is receivingly engaged in the enclosed slot;

and securing the first and second stud layout lockers together.

10. The method of claim 9 wherein the securing step comprises upsetting the upwardly-directed tab of the first stud layout locker.

11. The method of claim 10 wherein the second end of each stud layout locker comprises an upwardly-extending flange defining the enclosed slot, wherein the securing step comprises upsetting the upwardly directed tab of the first end of the first stud layout locker and the upwardly directed flange of the second end of the second stud layout locker.

* * * * *